US009033258B2

(12) United States Patent
Schwab et al.

(10) Patent No.: US 9,033,258 B2
(45) Date of Patent: May 19, 2015

(54) HIGH-PRESSURE CLEANING APPARATUS

(75) Inventors: Werner Schwab, Rudersberg (DE); Peter Pfaff, Markgroeningen (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 577 days.

(21) Appl. No.: 13/352,454

(22) Filed: Jan. 18, 2012

(65) Prior Publication Data

US 2012/0189471 A1 Jul. 26, 2012

Related U.S. Application Data

(63) Continuation of application No. PCT/EP2009/059650, filed on Jul. 27, 2009.

(51) Int. Cl.
*B05B 7/32* (2006.01)
*B08B 3/02* (2006.01)

(52) U.S. Cl.
CPC ..... *B08B 3/026* (2013.01); *B08B 2203/0247* (2013.01)

(58) Field of Classification Search
CPC ..... B08B 2203/0247
USPC ..... 239/146, 337, 332, 722, 745, 349, 351
See application file for complete search history.

(56) References Cited

U.S. PATENT DOCUMENTS

| | | | | |
|---|---|---|---|---|
| 3,575,348 | A * | 4/1971 | MacKay | 239/127 |
| 4,518,323 | A | 5/1985 | Elson et al. | |
| 4,583,921 | A | 4/1986 | Wolff et al. | |
| 5,653,584 | A | 8/1997 | Mazzucato et al. | |
| 5,667,141 | A | 9/1997 | Suttner | |
| 5,722,239 | A | 3/1998 | Houtman | |
| 5,752,661 | A * | 5/1998 | Lewis | 239/153 |
| 5,836,846 | A | 11/1998 | Hewko et al. | |
| 5,975,863 | A | 11/1999 | Mazzucato | |
| 6,092,998 | A | 7/2000 | Dexter et al. | |
| 6,112,641 | A | 9/2000 | Magri et al. | |
| 7,874,815 | B2 | 1/2011 | Wesch et al. | |
| 2006/0275146 | A1 * | 12/2006 | Williams | 417/234 |
| 2008/0029344 | A1 | 2/2008 | Wesch et al. | |
| 2009/0272412 | A1 | 11/2009 | Steinhauser et al. | |

FOREIGN PATENT DOCUMENTS

| | | |
|---|---|---|
| DE | 296 04 364 | 8/1997 |
| DE | 298 13 978 | 11/1998 |
| DE | 298 11 966 | 12/1998 |
| DE | 297 23 942 | 8/1999 |
| DE | 202 13 001 | 12/2002 |

(Continued)

*Primary Examiner* — Jason Boeckmann
(74) *Attorney, Agent, or Firm* — Lipsitz & McAllister, LLC

(57) ABSTRACT

In order to improve a high-pressure cleaning apparatus comprising a pump unit adapted to be driven by motor, a first connection element for detachable connection to a liquid supply conduit, said first connection element being connected to the suction side of the pump unit, and a second connection element for detachable connection to a high-pressure conduit, said second connection element being connected to the pressure side of the pump unit, such that it can be handled in a more user-friendly manner, the invention proposes that the first connection element and/or the second connection element be oriented in a direction facing upward away from a supporting surface for the high-pressure cleaning apparatus.

16 Claims, 3 Drawing Sheets

(56) References Cited

FOREIGN PATENT DOCUMENTS

| | | |
|---|---|---|
| DE | 10 2005 009 311 | 8/2006 |
| EP | 0 503 298 | 9/1992 |
| EP | 0 813 917 | 12/1997 |
| EP | 1 384 529 | 1/2004 |
| EP | 2 113 313 | 11/2009 |
| WO | WO 00/08335 | 2/2000 |

* cited by examiner

HIGH-PRESSURE CLEANING APPARATUS

This application is a continuation of international application number PCT/EP2009/059650 filed on Jul. 27, 2009.

The present disclosure relates to the subject matter disclosed in international application number PCT/EP2009/059650 of Jul. 27, 2009, which is incorporated herein by reference in its entirety and for all purposes.

BACKGROUND OF THE INVENTION

The invention relates to a high-pressure cleaning apparatus comprising a pump unit adapted to be driven by motor, a first connection element for detachable connection to a liquid supply conduit, said first connection element being connected to the suction side of the pump unit, and a second connection element for detachable connection to a high-pressure conduit, said second connection element being connected to the pressure side of the pump unit.

High-pressure cleaning apparatuses are known that have the pump unit mounted low on the high-pressure cleaning apparatus close to the supporting surface in order, for example, to achieve as low a centre of gravity as possible. The first connection element and the second connection element are positioned correspondingly low on the high-pressure cleaning apparatus in order to make the liquid conduits leading to and from the pump unit as short as possible. The low positioning of the connection elements makes it more difficult to connect them to the liquid supply conduit and the high-pressure conduit.

It is an object of the present invention to improve a high-pressure cleaning apparatus of the type mentioned at the outset such that it can be handled in a more user-friendly manner.

SUMMARY OF THE INVENTION

In accordance with the invention, this object is achieved in a high-pressure cleaning apparatus of the generic type by the first connection element and/or the second connection element being oriented in a direction facing upward away from a supporting surface for the high-pressure cleaning apparatus.

In the high-pressure cleaning apparatus in accordance with the invention, the first and/or the second connection element are oriented in an upward direction facing away from the supporting surface. On the one hand, this makes the first and/or the second connection element more easily recognizable to a user than would be the case with a high-pressure cleaning apparatus of the generic type. On the other hand, this makes it easier for the user to connect the liquid supply conduit to the first connection element and/or to connect the high-pressure conduit to the second connection element. Working from above, the user can arrange the liquid supply conduit on the first connection element and connect it therewith, and/or arrange the high-pressure conduit on the second connection element and connect it therewith, in a user-friendly manner.

It is advantageous for the first connection element and/or the second connection element to run in a direction facing obliquely upward away from the supporting surface. The oblique course of the first and/or the second connection element allows for a more user-friendly connection of the liquid supply conduit and/or the high-pressure conduit to the high-pressure cleaning apparatus by the user in a natural, undistorted body posture. For example, the first and/or the second connection element may be inclined by approximately 40° to 80°, and preferably by 50° to 70°, relative to a plane defined by the supporting surface.

It is advantageous for the first connection element and the second connection element to be oriented at approximately the same angle relative to the supporting surface. This facilitates the connection of the liquid supply conduit and the high-pressure conduit further, and it can in particular be achieved that a user need not change his/her body posture at all or only to an insignificant extent when connecting the liquid supply conduit and the high-pressure conduit to the high-pressure cleaning apparatus. In addition, an appealing appearance of the high-pressure cleaning apparatus can be achieved in this manner.

In particular, it is advantageous for the first connection element and the second connection element to be oriented approximately parallel to one another because this facilitates the connection of the liquid supply conduit and the high-pressure conduit to the high-pressure cleaning apparatus further and gives the latter an even more appealing appearance.

Preferably, the first connection element and/or the second connection element have a distance of approximately 15 cm or more from the supporting surface. This makes it possible to ensure that adequate space is left between the first and/or second connection elements and the supporting surface for the user to connect the liquid supply conduit and the high-pressure conduit, respectively. In an embodiment of such a high-pressure cleaning apparatus, it has proven advantageous in practice for the first and/or the second connection element to have a distance of approximately 15 cm to 45 cm, and preferably 25 cm to 40 cm, to the supporting surface.

In particular, provision may be made for the first connection element and the second connection element to have approximately the same distance to the supporting surface, so that a user can connect the liquid supply conduit and the high-pressure conduit while maintaining substantially the same body posture. In addition, such a high-pressure cleaning apparatus is given a more appealing appearance.

It is advantageous for the first connection element and the second connection element to be spaced apart from one another by approximately 5 cm to 20 cm. On the one hand, this enables a user to connect the connection elements, which are located close to one another, to the liquid supply conduit and the high-pressure conduit without substantially changing his/her body posture. On the other hand, an adequate interspace is present between the two connection elements so as to leave the user with sufficient freedom of movement to connect the liquid supply conduit and the high-pressure conduit to the high-pressure cleaning apparatus. The spacing between the two connection elements may in particular be approximately 10 cm to 15 cm.

A user's connecting the liquid supply conduit to the first connection element and connecting the high-pressure conduit to the second connection element is facilitated further if the first connection element and the second connection element are arranged on the same side of the high-pressure cleaning apparatus. In this case, the user can establish a connection of the respective conduit to the respective connection element without a substantial change in his/her body posture.

Preferably, the high-pressure cleaning apparatus includes a housing having at least one depression in which is arranged the first connection element and/or the second connection element. Provision may be made for each of the two connection elements to be arranged in a separate depression of the housing. The depression enables the housing to at least partially enclose the first and/or the second connection element, thus ensuring safe support thereof on the high-pressure cleaning apparatus. It is further possible to impart a more appealing appearance to the high-pressure cleaning apparatus if, for example, the first and/or the second connection element protrude from the at least one depression only far enough to allow their connection to the liquid supply conduit and the high-pressure conduit, respectively.

Provision may be made for the housing to form a recess above the at least one depression. This provides adequate space above the at least one depression for the liquid supply conduit and/or the high-pressure conduit to be connected to the high-pressure cleaning apparatus.

In an embodiment of the high-pressure cleaning apparatus it has proven advantageous in practice for the at least one depression to be arranged on the housing at a side thereof, for example at a left side wall of the housing and preferably in an area thereof that faces towards a rear side of the high-pressure cleaning apparatus.

Preferably, the at least one depression is arranged above a wheel, in particular a running wheel, of the high-pressure cleaning apparatus. Practice has shown that the first and/or the second connection element are within easy reach of a user in this manner. If the at least one depression is positioned above the wheel, it is possible to achieve a large enough distance of the first and/or the second connection element from the supporting surface. These can therefore be reached more easily by the user.

It is advantageous for the first connection element and/or the second connection element not to project laterally beyond a footprint of the high-pressure cleaning apparatus. This reduces the risk of a user accidentally contacting, in particular knocking against the first and/or the second connection element, thereby damaging the high-pressure cleaning apparatus. Provision may be made for the high-pressure cleaning apparatus to be adapted to assume an operative position and an inoperative position, different from said operative position, relative to the supporting surface. In this case, it is advantageous for the first connection element and/or the second connection element not to project laterally beyond the footprint at least in the inoperative position, but preferably also in the operative position.

It is advantageous for the first connection element and/or the second connection element to have, in projection to the supporting surface, a distance to a lateral boundary of the footprint of approximately 5 cm to 15 cm. This makes it possible to reduce the risk of a user accidentally contacting, in particular knocking against the first and/or the second connection element, thereby damaging the high-pressure cleaning apparatus. It is further possible, even when a liquid supply conduit and/or a high-pressure conduit in the form of a hose is connected to the first and the second connection element, respectively, for these hoses to be supported on the high-pressure cleaning apparatus in such a manner that they likewise do not project laterally beyond the footprint of the high-pressure cleaning apparatus. Supporting a hose in such a manner on the high-pressure cleaning apparatus proves advantageous during a break at work, for example. Also in this case, it is thus possible to ensure that the risk of damage to the high-pressure cleaning apparatus by accidentally contacting, in particular knocking against the liquid supply conduit and/or the high-pressure conduit can be reduced.

It is advantageous for the first connection element to be connected to the pump unit via a suction conduit and/or for the second connection element to be connected to the pump unit via a discharge conduit. In particular, provision may be made for the first and/or the second connection element to be configured as part of the suction conduit and as part of the discharge conduit, respectively. Use of a suction conduit and/or a discharge conduit allows the first and/or the second connection element to be configured so as to be no larger than necessary. At the same time, a position of the first and/or the second connection element can still be selected in which the user can connect the liquid supply conduit and/or the high-pressure conduit to the high-pressure cleaning apparatus in a user-friendly manner.

It is advantageous for the suction conduit, at least with a section thereof adjoining the first connection element, and/or for the discharge conduit, at least with a section thereof adjoining the second connection element, to run in a direction facing downward towards the supporting surface. This makes it possible to position the first and/or the second connection element at a greater distance to the supporting surface, thus facilitating a user's connecting the liquid supply conduit and high-pressure conduit, respectively.

To achieve a simple construction of the high-pressure cleaning apparatus and to save costs, it is advantageous for the suction conduit and/or the discharge conduit to be of one-piece configuration. In particular, the suction conduit may be formed of a one-piece moulded plastic part.

Preferably, the high-pressure cleaning apparatus is configured as a heatable high-pressure cleaning apparatus having a heat exchanger for heating the liquid in the discharge conduit. The heat exchanger, which may, for example, be operated using a fossil fuel, makes it possible to heat up the liquid in the discharge conduit, which has been put under high pressure by the pump unit, thus achieving an improved cleaning effect.

It is advantageous for the high-pressure cleaning apparatus to comprise a reel for accommodating a high-pressure hose forming the high-pressure conduit. The high-pressure hose can, at least in part, be wound on the reel and thus be stored in a space-saving and user-friendly manner.

The following description of preferred embodiments of the invention serves to explain the invention in greater detail in conjunction with the drawings.

DETAILED DESCRIPTION OF THE INVENTION

Figure 1:
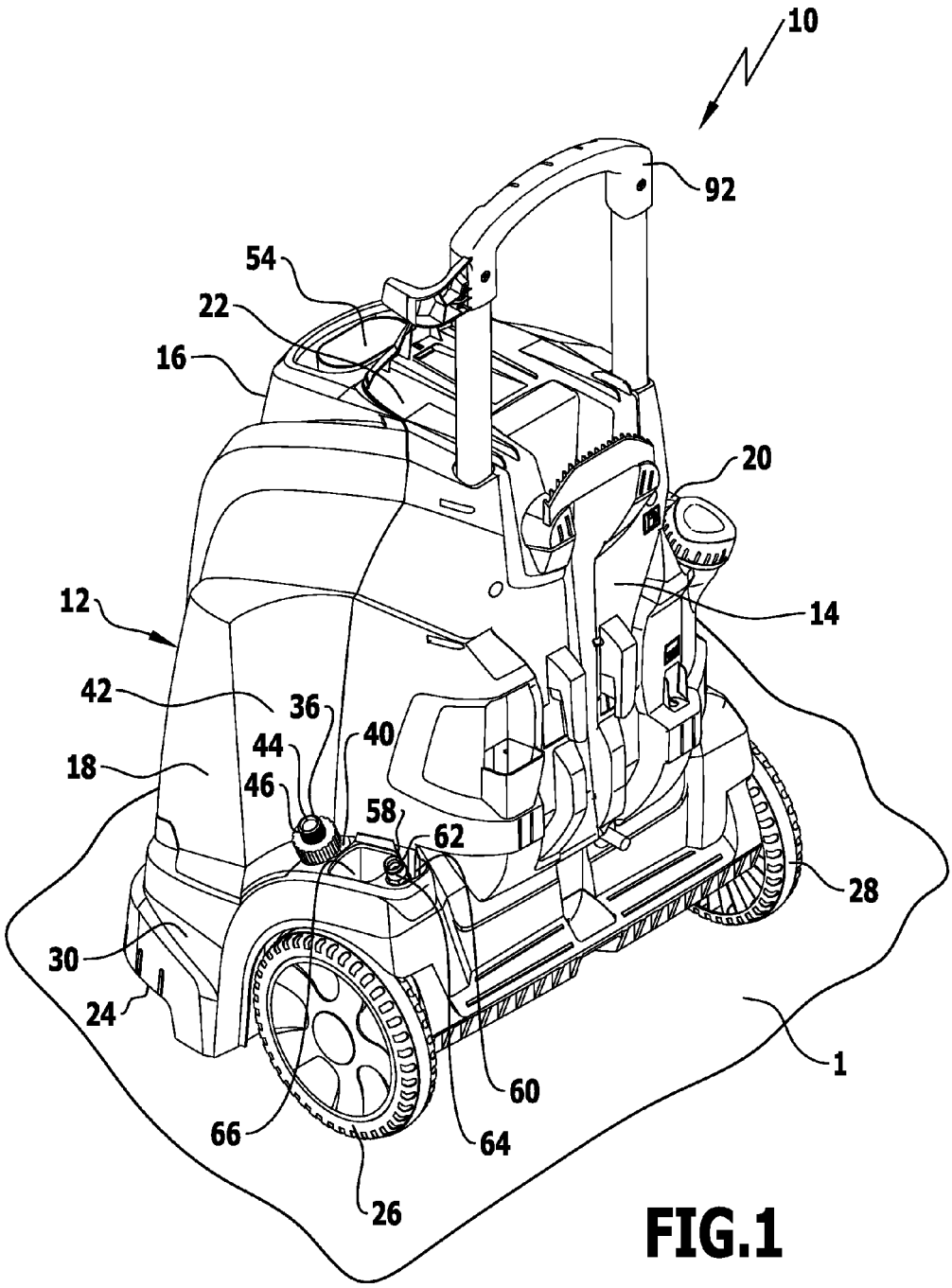
FIG. 1 is a perspective view of a first preferred embodiment of a high-pressure cleaning apparatus in accordance with the invention, including a housing.

A first preferred embodiment of a high-pressure cleaning apparatus in accordance with the invention is shown in the perspective view of FIG. 1 and is generally indicated therein by the reference numeral 10. The high-pressure cleaning apparatus 10 has a housing 12 which is approximately cuboidal in shape and composed of a plurality of parts and includes a back side 14, a front side 16, a left side 18, a right side 20, a top side 22 and a bottom side 24. At the bottom side 24, in areas of the left side 18 and the right side 20 that face towards the back side 14, the housing 12 has mounted thereon two wheels 26 and 28, respectively.

At the bottom side 24, the housing 12 forms a support element in the form of a support foot which is known per se and not shown in the drawing. This support foot and the wheels 26 and 28 enable the high-pressure cleaning apparatus 10 to stand on a supporting surface 1 in the upright position shown in FIG. 1. Said upright position may be assumed by the high-pressure cleaning apparatus 10 both during operation, in which a liquid supply conduit and a high-pressure conduit are connected to the high-pressure cleaning apparatus 10 in the manner described in the following, and also when the high-pressure cleaning apparatus is not in operation. Thus, the upright position of the high-pressure cleaning apparatus 10 shown in FIG. 1 is an operative position thereof and an inoperative position thereof.

Figure 2:
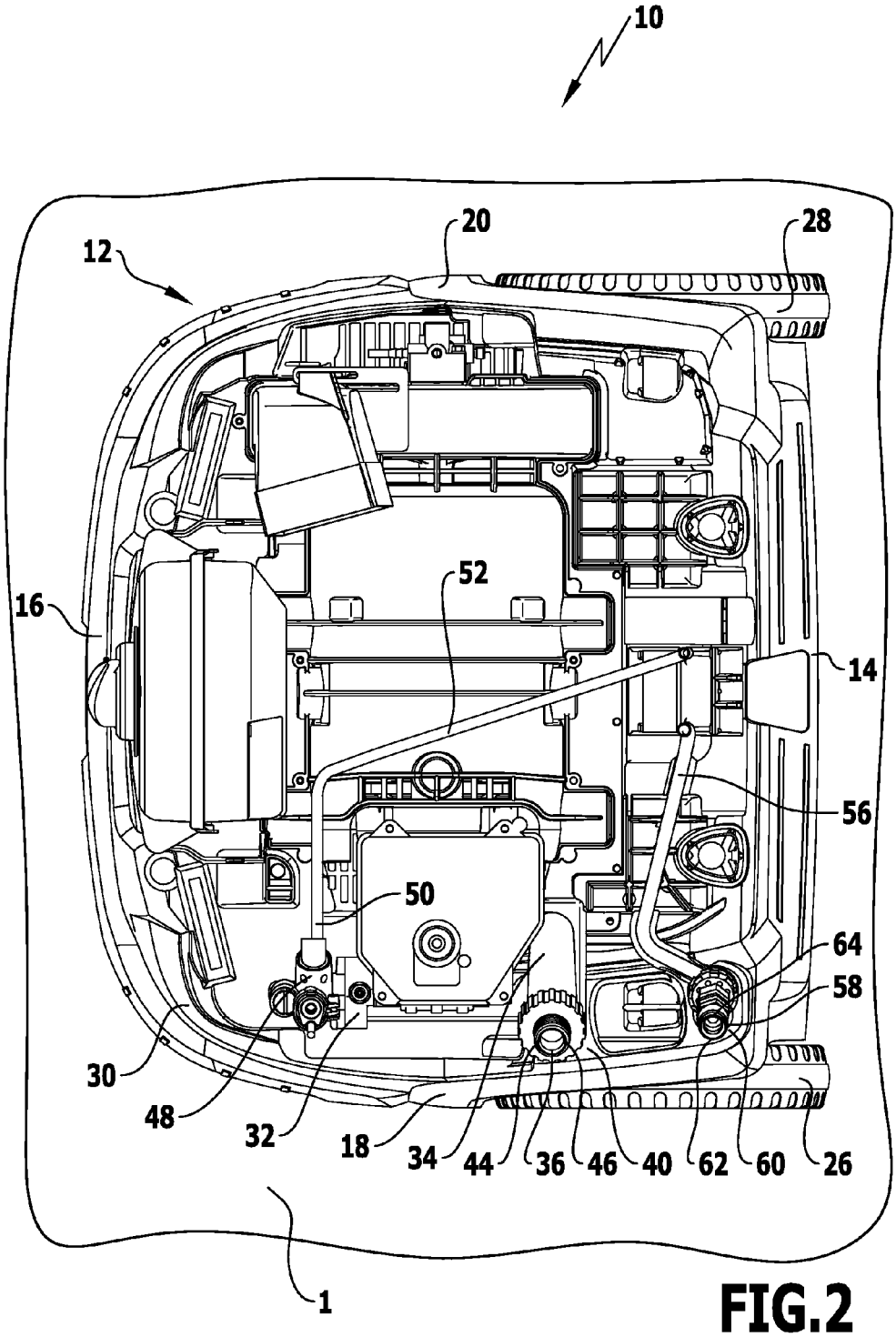
FIG. 2 is a top view of a lower part of the housing of the high-pressure cleaning apparatus of FIG. 1.

Supported on a housing base 30 which forms the lower part of the housing 12 is a pump unit in the form of a high-pressure pump 32 (FIG. 2). The high-pressure pump 32 is arranged on the housing base 30 approximately centrally between the back side 14 and the front side 16 in an area facing towards the left side 18. The high-pressure pump 32, in a manner known per se, is driven by an electric motor of the high-pressure cleaning apparatus 10, not shown in the drawing, so that a liquid, in particular water, which is supplied to the high-pressure cleaning apparatus 10 can be pressurized to thereby enhance the cleaning effect.

To supply the high-pressure pump 32 with liquid to be pressurized, the high-pressure pump 32 has a suction side thereof connected to a suction conduit 34, for example by flanged connection. The suction conduit 34 may be of one-piece configuration and in particular consist of a moulded plastic part. Starting from the high-pressure pump 32, the suction conduit 34 rises obliquely upward at an angle of approximately 60° relative to the supporting surface 1 and is, in part, embedded in a trough-like depression 40 which is formed by the housing base 30 on the left side 18 above the left wheel 26. An end 36 of the suction conduit 34 facing away from the high-pressure pump 32 is thus positioned in the area of a recess 42 that is formed by the left side 18 of the housing 12 being offset in a direction towards the centre of the high-pressure cleaning apparatus 10 above the left wheel 26.

At its end 36, the suction conduit 34 forms a first connection element 44 in the form of a connection piece 46 for detachably connecting a liquid supply conduit, not shown in the drawing and known per se, to the high-pressure cleaning apparatus 10. As is known, the liquid supply conduit is typically configured as a flexible hose tubing.

Liquid which is supplied to the high-pressure pump 32 via the connection piece 46 and the suction conduit 34 can exit from there through a pump outlet 48. Connected to the pump outlet 48 of the high-pressure pump 32 is a discharge conduit 50 which, with a first section 52 thereof located near the pump outlet 48, initially runs in a direction parallel to the top side of the housing base 30. Adjoining the first section 52 is a second section which, in a manner known per se and not shown, forms windings of a heat exchanger 54, only partially visible in FIG. 1, which can be used to heat up the liquid under pressure in the discharge conduit 50 to thereby enhance the cleaning effect.

Downstream of the heat exchanger 54, the discharge conduit 50 comprises a third section 56 which again runs approximately parallel to the top side of the housing base 30. However, at its end 58 that faces away from the high-pressure pump 32, the discharge conduit 50, with its third section 56, rises obliquely upward at an angle of approximately 60° relative to the supporting surface 1. It is partially embedded in a depression 60 which is formed by the housing base 30 in the vicinity of the depression 40 above the left wheel 26. Near the back side 14, the discharge conduit 50 exits from the housing 12, with the end 58 thereof likewise being arranged in the area of the recess 42 of the housing 12.

The end 58 of the discharge conduit 50 is formed by a second connection element 62 in the form of a high-pressure connection 64 known per se. The high-pressure connection 64 may detachably connect to a high-pressure conduit, not shown in the drawing and known per se, which may be, for example, in the form of a customary high-pressure hose.

As has already been mentioned, the suction conduit 34 and the discharge conduit 50, in the area of their ends 36 and 58, respectively, run obliquely upward in a direction facing away from the supporting surface 1 for the high-pressure cleaning apparatus 10. Thus, the connection piece 46 and the high-pressure connection 64 are oriented in a direction facing obliquely upward away from the supporting surface 1. They adopt an angle of approximately 50° to 70°, and typically 60°, relative to a plane defined by the supporting surface 1. They are located at a distance of approximately 35 cm to 40 cm from the supporting surface 1, their distance from the supporting surface 1 being approximately the same.

Although in the case of the high-pressure cleaning apparatus 10, the high-pressure pump 32 is arranged close to the bottom side 24 in order to achieve a low centre of gravity, the above-mentioned arrangement of the connection piece 46 and the high-pressure connection 64 makes it possible for a user to detachably connect the liquid supply conduit and the high-pressure conduit to the high-pressure cleaning apparatus 10 in a user-friendly manner. Connecting the liquid supply conduit and the high-pressure conduit to the connection piece 46 and the high-pressure connection 64, respectively, can take place in particular from above while the user, owing to the inclination of the connection piece 46 and the high-pressure connection 64 relative to the vertical, can assume a natural body posture.

A user can connect the liquid supply conduit to the connection piece 46 and connect the high-pressure conduit to the high-pressure connection 64 without a substantial change in body posture because the connection piece 46 and the high-pressure connection 64 are arranged close together on the left side 18 above the left wheel 26. They are spaced apart by a distance of, for example, 10 cm to 15 cm. At the same time, this distance is sufficient to prevent a user from perceiving it as cumbersome to connect the high-pressure conduit to the high-pressure connection 64 with the liquid supply conduit already connected to the connection piece 46, and vice versa, because it leaves the user with sufficient freedom of movement.

The interspace between the connection piece 46 and the high-pressure connection 64 is also well utilized because a depression 66 formed by the housing base 30 is located between the depressions 40 and 60. An accessory part for the high-pressure cleaning apparatus 10, for example a jet pipe, a lance or a nozzle, can be inserted into the depression 66, it being possible to also utilize the space created by the recess 42 above the left wheel 26.

In the high-pressure cleaning apparatus 10, it has further proven advantageous for the connection piece 46 and the high-pressure connection 64 to run approximately parallel to one another. On the one hand, this imparts an appealing appearance to the high-pressure cleaning apparatus 10. On the other hand, it helps to avoid potential conflicts between a liquid supply conduit and a high-pressure conduit, in particular where these are each configured as flexible hose tubings. The parallel arrangement of the connection piece 46 and the high-pressure connection 64 in spaced relation relative to one another reduces the risk of the hose tubings interfering with one another, for example by twisting and/or entangling.

The advantages described above in terms of connecting a liquid supply conduit and a high-pressure conduit to the high-pressure cleaning apparatus 10 apply analogously to disconnecting them from the high-pressure cleaning apparatus 10, which in each case can also be performed by a user in a user-friendly manner.

As may be seen in particular from FIG. 2, both the connection piece 46 and the high-pressure connection 64 do not project laterally beyond a footprint of the high-pressure cleaning apparatus 10. In projection to the supporting surface 1, they have in particular a distance of, for example, 5 cm to 15 cm, typically approximately 10 cm, to a lateral boundary of the footprint.

This is advantageous as it reduces the risk, both in the operative and in the inoperative position, of a user accidentally contacting, in particular knocking against the connection piece 46 and/or the high-pressure connection 64, thereby damaging the high-pressure cleaning apparatus 10.

The distances of the connection piece 46 and the high-pressure connection 64 from the lateral boundary of the footprint reduce the risk of damage to the high-pressure cleaning apparatus 10 even when the connection piece 46 and the high-pressure connection 64 have connected thereto a liquid supply conduit and a high-pressure conduit, respectively, in the form of hose tubings. These can be stored, for example, in a wound-up condition on the top side 22 of the housing 12, wherein they are arranged starting from the connection piece 46 or the high-pressure connection 64 in the area of the recess 42. In this case, the hose tubings also do not project beyond the lateral boundary of the high-pressure cleaning apparatus 10. The risk of a user accidentally contacting, in particular knocking against the hose tubings is thereby reduced.

Figure 3:
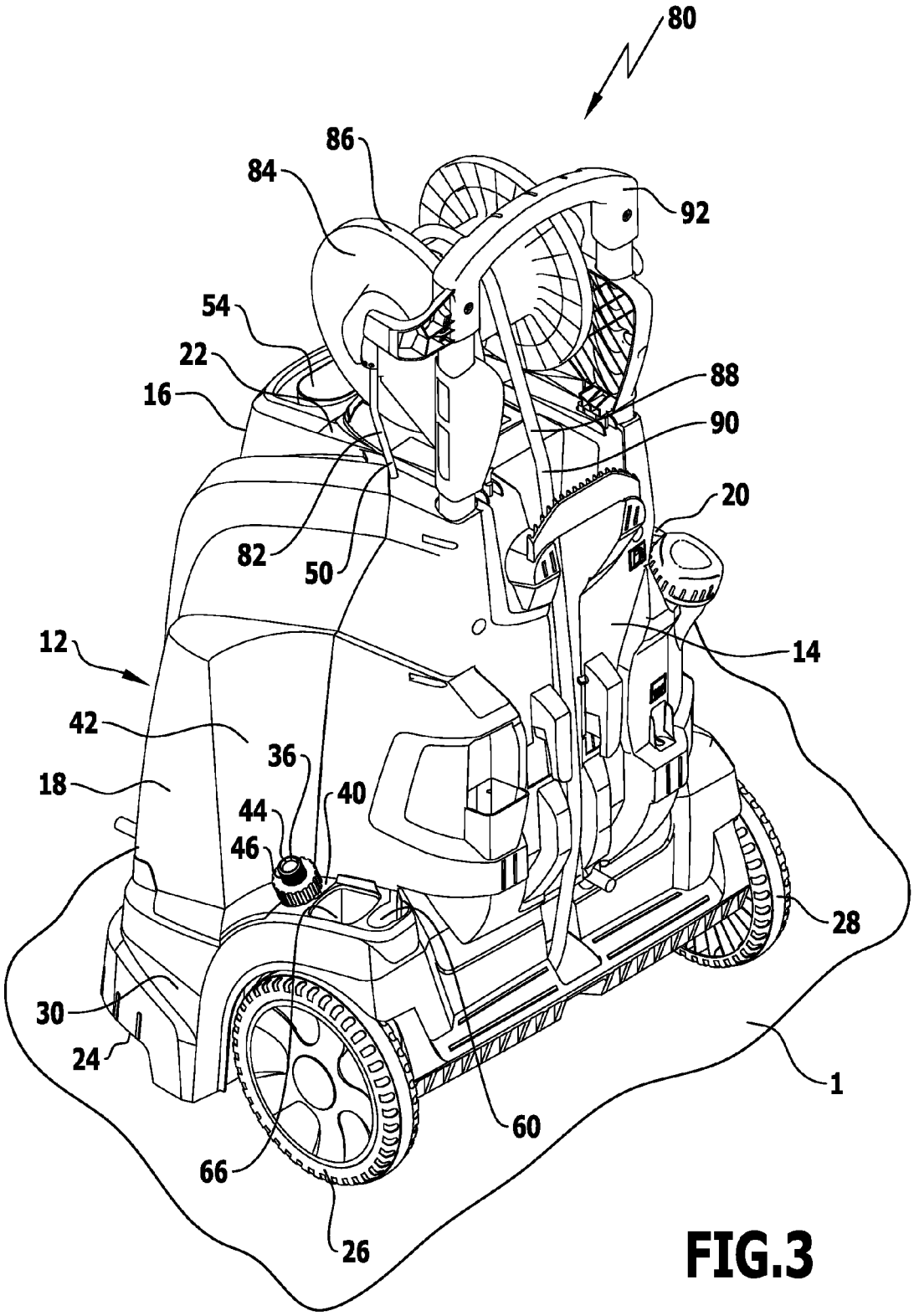
FIG. 3 is a perspective view of a second preferred embodiment of a high-pressure cleaning apparatus in accordance with the invention.

A second preferred embodiment of a high-pressure cleaning apparatus in accordance with the invention is shown in the perspective view of FIG. 3 and is generally indicated therein by the reference numeral 80. Components and features of the high-pressure cleaning apparatus 80 which are configured to be the same or have the same effect as the components and features of the high-pressure cleaning apparatus 10 are given the same reference numerals. The advantages of the high-pressure cleaning apparatus 10 that can be achieved with these components and features can also be achieved with the high-pressure cleaning apparatus 80.

In the high-pressure cleaning apparatus 80, the end of the discharge conduit 50 facing away from the high-pressure pump 32 is formed by a third section 82 which adjoins a second section, not shown in the drawing, below the heat exchanger 54. Said third section 82 runs in a vertical direction and exits from the housing 12 on the top side 22 thereof near the left side 18.

With one end thereof, not shown in the drawing and facing away from the heat exchanger 54, the third section 82 enters the housing 84 of a hose reel 86 arranged on the top side 22 and forms, at the end thereof, a high-pressure connection. The latter is connected, in a manner known per se and therefore not discussed in greater detail here, to a high-pressure conduit 88 in the form of a high-pressure hose 90. The high-pressure hose 90 can be wound onto the hose reel 86 and stored thereon in a space-saving and user-friendly manner. The hose reel 86 is supported on a U-shaped handle grip 92 which extends from the top side 22 in a vertical direction and serves to tilt and move the high-pressure cleaning apparatus 80.

The invention claimed is:

1. High-pressure cleaning apparatus, comprising:

a housing with a housing base forming a lower part of the housing, a pump unit supported on the housing base and adapted to be driven by motor, a first connection element for detachable connection to a liquid supply conduit, said first connection element being connected to a suction side of the pump unit, the first connection element being connected to the pump unit via a suction conduit which runs in a direction facing downward towards a supporting surface for the high-pressure cleaning apparatus, at least in a section thereof adjoining the first connection element, and a second connection element for detachable connection to a high-pressure conduit, said second connection element being connected to a pressure side of the pump unit, wherein:

the first connection element oriented in a direction facing upward away from the supporting surface;

the suction conduit is partially embedded in a depression formed by the housing base directly above a wheel of the high-pressure cleaning apparatus;

the first connection element is formed at an end of the suction conduit facing away from the pump unit and is positioned in an area of a recess of the housing formed directly above the wheel; and the recess is formed by a portion of the housing being offset towards a center of the high-pressure cleaning apparatus.

2. High-pressure cleaning apparatus in accordance with claim 1, wherein at least one of the first connection element and the second connection element runs in a direction facing obliquely upward away from the supporting surface.

3. High-pressure cleaning apparatus in accordance with claim 1, wherein the first connection element and the second connection element are oriented at approximately a same angle relative to the supporting surface.

4. High-pressure cleaning apparatus in accordance with claim 1, wherein at least one of the first connection element and the second connection element has a distance of approximately 15 cm or more from the supporting surface.

5. High-pressure cleaning apparatus in accordance with claim 1, wherein the first connection element and the second connection element are spaced apart from one another by approximately 5 cm to 20 cm.

6. High-pressure cleaning apparatus in accordance with claim 1, wherein the first connection element and the second connection element are arranged on a same side of the high-pressure cleaning apparatus.

7. High-pressure cleaning apparatus in accordance with claim 1, wherein the recess is arranged on the housing at a side thereof.

8. High-pressure cleaning apparatus in accordance with claim 1, wherein at least one of the first connection element and the second connection element does not project laterally beyond a footprint of the high-pressure cleaning apparatus.

9. High-pressure cleaning apparatus in accordance with claim 8, wherein the first connection element and the second connection element, in a projection to the supporting surface, has a distance to a lateral boundary of the footprint of approximately 5 cm to 15 cm.

10. High-pressure cleaning apparatus in accordance with claim 1, wherein the suction conduit is of a one-piece configuration.

11. High-pressure cleaning apparatus in accordance with claim 1, wherein the second connection element is connected to the pump unit via a discharge conduit.

12. High-pressure cleaning apparatus in accordance with claim 11, wherein the discharge conduit, at least with a section thereof adjoining the second connection element, runs in the direction facing downward towards the supporting surface.

13. High-pressure cleaning apparatus in accordance with claim 11, wherein the discharge conduit is of a one-piece configuration.

14. High-pressure cleaning apparatus in accordance with claim 11, wherein the high-pressure cleaning apparatus is configured as a heatable high-pressure cleaning apparatus having a heat exchanger for heating liquid in the discharge conduit.

15. High-pressure cleaning apparatus in accordance with claim 1, further comprising a reel for accommodating a high-pressure hose forming the high-pressure conduit.

16. High-Pressure cleaning apparatus in accordance with claim 1, wherein:

the second connection element is oriented in the direction facing upward away from the supporting surface;

the second connection element is connected to the pump unit via a discharge conduit which runs in a direction facing downward towards the supporting surface, at least in a section thereof adjoining the second connection element, the discharge conduit is partially embedded in one of the depression or a further depression formed by the housing base above a wheel of the high-pressure cleaning apparatus; and the second connection element is formed at an end of the discharge conduit facing away from the pump unit and is positioned in the area of the recess of the housing formed above the wheel.

* * * * *

UNITED STATES PATENT AND TRADEMARK OFFICE

CERTIFICATE OF CORRECTION

PATENT NO. : 9,033,258 B2
APPLICATION NO. : 13/352454
DATED : May 19, 2015
INVENTOR(S) : Schwab et al.

It is certified that error appears in the above-identified patent and that said Letters Patent is hereby corrected as shown below:

On the Title page of the patent, the Inventors are corrected to read:

(75) Inventors: Werner Schwab, Rudersberg (DE);
Peter Pfaff, Aichwald (DE)

In the Claims:

Column 8, line 11: "the first connection element oriented in a direction fac-" should read
-- the first connection element is oriented in a direction fac- --

Column 8, line 53: "claim 8, wherein the first connection element and the second" should read
-- claim 8, wherein at least one of the first connection element and the second --

Signed and Sealed this
Twenty-ninth Day of September, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 9,033,258 B2
APPLICATION NO. : 13/352454
DATED : May 19, 2015
INVENTOR(S) : Schwab et al.

It is certified that error appears in the above-identified patent and that said Letters Patent is hereby corrected as shown below:

On the Title page of the patent, the Inventors are corrected to read:

(75) Inventors: Werner Schwab, Rudersberg (DE);
Peter Pfaff, Aichwald (DE)

In the Claims:

Column 8, line 11: "the first connection element oriented in a direction fac-" should read
-- the first connection element is oriented in a direction fac- --

Column 8, line 51: "claim 8, wherein the first connection element and the second" should read
-- claim 8, wherein at least one of the first connection element and the second --

This certificate supersedes the Certificate of Correction issued September 29, 2015.

Signed and Sealed this
Twenty-fourth Day of November, 2015

Michelle K. Lee

Michelle K. Lee
*Director of the United States Patent and Trademark Office*